United States Patent [19]

Huang et al.

[11] Patent Number: 4,923,534

[45] Date of Patent: May 8, 1990

[54] TUNGSTEN-MODIFIED TITANIUM ALUMINUM ALLOYS AND METHOD OF PREPARATION

[75] Inventors: Shyh-Chin Huang, Latham; Michael F. X. Gigliotti, Jr., Scotia, both of N.Y.

[73] Assignee: General Electric Company, Schenectady, N.Y.

[21] Appl. No.: 252,622

[22] Filed: Oct. 3, 1988

[51] Int. Cl.[5] ..... C22C 14/00

[52] U.S. Cl. ..... 148/407; 148/11.5 F; 148/133; 420/418; 420/580

[58] Field of Search ..... 420/418, 580; 148/133, 148/11.5 F, 407

[56] References Cited

U.S. PATENT DOCUMENTS 4,661,316 4/1987 Hashimoto et al. ..... 420/418

FOREIGN PATENT DOCUMENTS 0220571 7/1957 Australia .

OTHER PUBLICATIONS

Martin et al., in Titanium '80, ASM, vol. 2, 1980, pp. 1245–1254.

Martin et al., Met. Trans. 14A (1983), pp. 2170–2174.

Vujic et al., Met. Trans. 19A (Oct. 1988), 2445.

*Primary Examiner*—Upendra Roy

*Attorney, Agent, or Firm*—Paul E. Rochford; James C. Davis, Jr.; James Magee, Jr.

[57] ABSTRACT

A TiAl composition is prepared to have high strength and to have improved ductility by altering the atomic ratio of the titanium and aluminum to have what has been found to be a highly desirable effective aluminum concentration by addition of tungsten and rapid solidification from the melt according to the approximate formula $Ti_{50-48}Al_{48}W_{2-4}$.

7 Claims, 6 Drawing Sheets

TUNGSTEN-MODIFIED TITANIUM ALUMINUM ALLOYS AND METHOD OF PREPARATION

CROSS REFERENCE TO RELATED APPLICATIONS

The subject application relates to copending applications as follows:

Serial No. 138,476, filed 12/28/87, U.S. Pat. No. 4,857,268;

Serial No. 138,486, filed 12/28/87, U.S. Pat. No. 4,842,820;

Serial No. 138,481, filed 12/28/87, U.S. Pat. No. 4,842,819;

Serial No. 138,407, filed 12/28/87, U.S. Pat. No. 4,836,983;

Serial No. 138,408 filed 12/28/87; abandoned;

Serial No. 201,984 filed June 3, 1988;

Serial No. 07/253,659 filed 10/3/88; and

Serial No. 07/293,035 filed 1/3/89.

The texts of these related applications are incorporated herein by reference.

BACKGROUND OF THE INVENTION

The present invention relates generally to alloys of titanium and aluminum. More particularly it relates to alloys of titanium and aluminum which have been modified both with respect to stoichiometric ratio and with respect to tungsten addition.

It is known that as aluminum is added to titanium metal in greater and greater proportions the crystal form of the resultant titanium aluminum composition changes. Small percentages of aluminum go into solid solution in titanium and the crystal form remains that of alpha titanium. At higher concentrations of aluminum (including about 25 to 35 atomic %) an intermetallic compound $Ti_3Al$ is formed. The $Ti_3Al$ has an ordered hexagonal crystal form called alpha-2. At still higher concentrations of aluminum (including the range of 50 to 60 atomic % aluminum) another intermetallic compound, TiAl, is formed having an ordered tetragonal crystal form called gamma.

The alloy of titanium and aluminum having a gamma crystal form and a stoichiometric ratio of approximately one is an intermetallic compound having a high modulus, a low density, a high thermal conductivity, good oxidation resistance, and good creep resistance. The relationship between the modulus and temperature for TiAl compounds to other alloys of titanium and in relation to nickel base superalloys is shown in FIG. 1. As is evident from the figure the TiAl has the best modulus of any of the titanium alloys. Not only is the TiAl modulus higher at temperature but the rate of decrease of the modulus with temperature increase is lower for TiAl than for the other titanium alloys. Moreover, the TiAl retains a useful modulus at temperatures above those at which the other titanium alloys become useless. Alloys which are based on the TiAl intermetallic compound are attractive lightweight materials for use where high modulus is required at high temperatures and where good environmental protection is also required.

One of the characteristics of TiAl which limits its actual application to such uses is a brittleness which is found to occur at room temperature. Also the strength of the intermetallic compound at room temperature needs improvement before the TiAl intermetallic compound can be exploited in structural component applications. Improvements of the TiAl intermetallic compound to enhance ductility and/or strength at room temperature are very highly desirable in order to permit use of the compositions at the higher temperatures for which they are suitable.

Because these are potential benefits of use of TiAl at high temperatures including the advantage of its lighter weight, what is most desired in the TiAl compositions which are to be used is a combination of strength and ductility at room temperature. A minimum ductility of the order of one percent is acceptable for some applications of the metal composition but higher ductilities are much more desirable. A minimum strength for a composition to be useful is about 50 ksi or about 350 MPa. However, materials having this level of strength are of marginal utility and higher strengths are often preferred for some applications.

The stoichiometric ratio of TiAl compounds can vary over a range without altering the crystal structure. The aluminum content can vary from about 50 to about 60 atom percent. The properties of TiAl compositions are subject to very significant changes in the properties displayed as a result of relatively small changes of one percent or more in the stoichiometric ratio of the titanium and aluminum ingredients. Also the properties are similarly affected by the addition of relatively similar small amounts of ternary elements.

PRIOR ART

There is extensive literature on the compositions of titanium aluminum including the $Ti_3Al$ intermetallic compound, the TiAl intermetallic compounds and the $TiAl_3$ intermetallic compound. A patent, 4,294,615, entitled "Titanium Alloys of the TiAl Type" and naming Blackburn and Smith as inventors, contains an extensive discussion of the titanium aluminide type alloys including the TiAl intermetallic compound. As is pointed out in the patent in column 1 starting at line 50 in discussing TiAl's advantages and disadvantages relative to $Ti_3Al$:

> "It should be evident that the TiAl gamma alloy system has the potential for being lighter inasmuch as it contains more aluminum. Laboratory work in the 1950's indicated that titanium aluminide alloys had the potential for high temperature use to about 1000° C. But subsequent engineering experience with such alloys was that, while they had the requisite high temperature strength, they had little or no ductility at room and moderate temperatures, i.e., from 20° to 550° C. Materials which are too brittle cannot be readily fabricated, nor can they withstand infrequent but inevitable minor service damage without cracking and subsequent failure. They are not useful engineering materials to replace other base alloys."

It is known that the alloy system TiAl is substantially different from $Ti_3Al$ (as well as from solid solution alloys of Ti) although both TiAl and $Ti_3Al$ are basically ordered titanium aluminum intermetallic compounds. As the '615 patent points out at the bottom of column 1:

> "Those well skilled recognize that there is a substantial difference between the two ordered phases. Alloying and transformational behavior of $Ti_3Al$ resemble those of titanium as the hexagonal crystal structures are very similar. However, the compound TiAl has a tetragonal arrangement of atoms and thus rather different alloying characteristics. Such a distinction is often not recognized in the earlier literature."

The '615 patent describes the alloying of TiAl with vanadium and carbon to achieve some property improvements in the resulting alloy.

In Table 2 of the '615 patent two TiAl compositions containing tungsten are disclosed. Alloy $T_2A$-128 is disclosed to contain Ti-48Al-1.0W and alloy $T_2A$-127 is disclosed to contain Ti-48Al-1.0V-1.0W.

In the text below Table 2, it is pointed out that "the effects of the alloying additions are summarized in FIG. 3 for Ti-48Al. Referring to FIG. 3, it can be seen that all additions increased creep life but it is seen that tungsten lowers ductility while vanadium raises or preserves it: compare alloy 128 with 125."

The influence of tungsten in lowering ductility is pointed out further in column 5 starting at line 51 in the statement that "most elements such as Mo and W tend to lower ductility somewhat and may reduce creep rupture properties."

The negative influence of tungsten on ductility at room temperature is evident from FIG. 3. From FIG. 3 it is evident that the "RT % Elong." of alloy 128 containing 1% tungsten in the base alloy is less than half that of the base Ti-Al 48 alloy. The ductility of alloy 127 containing 1% tungsten and 1% vanadium in the base alloy is even lower.

A number of technical publications dealing with the titanium aluminum compounds as well as with the characteristics of these compounds are as follows:

1. E. S. Bumps, H. D. Kessler, and M. Hansen, "Titanium-Aluminum System", *Journal of Metals,* TRANSACTIONS AIME, Vol. 194 (June 1952) pp. 609–614.

2. H. R. Ogden, D. J. Maykuth, W. L. Finlay, and R. I. Jaffee, "Mechanical Properties of High Purity Ti-Al Alloys", *Journal of Metals,* TRANSACTIONS AIME, Vol. 197 (February 1953) pp. 267–272.

3. Joseph B. McAndrew, and H. D. Kessler, "Ti-36 Pct Al as a Base for High Temperature Alloys", *Journal of Metals,* TRANSACTIONS AIME, Vol. 206 (October 1956) pp. 1348–1353.

4. Patrick L. Martin, Madan G. Mendiratta, and Harry A. Lispitt, "Creep Deformation of TiAl and TiAl+W alloys", Metallurgical Transactions A, Volume 14A (October 1983) pp. 2171–2174.

5. P. L. Martin, H. A. Lispitt, N. T. Nuhfer, and J. C. Williams, "The Effects of Alloying on the Microstructure and Properties of $Ti_3Al$ and TiAl", *Titanium* 80, (Published by American Society for Metals, Warrendale, PA), Vol. 2, pp. 1245–1254.

BRIEF DESCRIPTION OF THE INVENTION

One object of the present invention is to provide a method of forming a titanium aluminum intermetallic compound having improved ductility and related properties at room temperature.

Another object is to improve the properties of titanium aluminum intermetallic compounds at low and intermediate temperatures.

Another object is to provide an alloy of titanium and aluminum having improved properties and processability at low and intermediate temperatures.

Other objects will be in part, apparent and in part, pointed out in the description which follows.

In one of its broader aspects the objects of the present invention are achieved by providing a nonstoichiometric TiAl base alloy, and adding a relatively low concentration of tungsten to the nonstoichiometric composition. The addition may be followed by rapidly solidifying the tungsten-containing nonstoichiometric TiAl intermetallic compound. Addition of tungsten in the order of approximately 1 to 5 parts in 100 is contemplated.

The rapidly solidified composition may be consolidated as by isostatic pressing and extrusion to form a solid composition of the present invention.

DETAILED DESCRIPTION OF THE INVENTION

EXAMPLES 1–3

Figure 1:
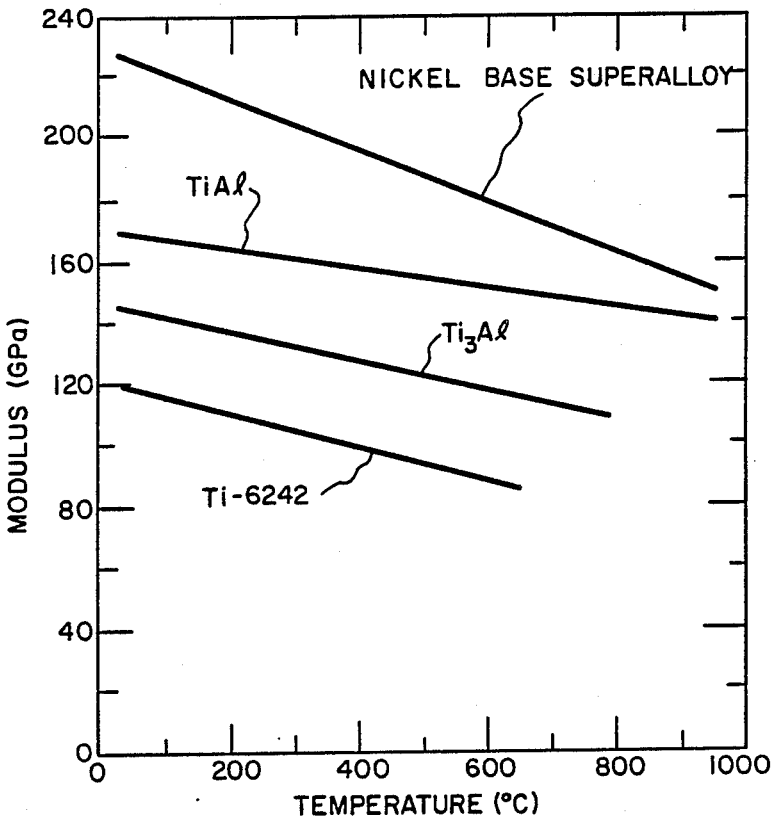
FIG. 1 is a graph illustrating the relationship between modulus and temperature for an assortment of alloys.

Three individual melts were prepared to contain titanium and aluminum in various stoichiometric ratios approximating that of TiAl. The compositions, annealing temperatures and test results of tests made on the compositions are set forth in Table I.

For each example the alloy was first made into an ingot by electro arc melting. The ingot was processed into ribbon by melt spinning in a partial pressure of argon. In both stages of the melting, a water-cooled copper hearth was used as the container for the melt in order to avoid undesirable melt-container reactions. Also care was used to avoid exposure of the hot metal to oxygen because of the strong affinity of titanium for oxygen.

The rapidly solidified ribbon was packed into a steel can which was evacuated and then sealed. The can was then hot isostatically pressed (HIPped) at 950° C. (1740° F.) for 3 hours under a pressure of 30 ksi. The HIPping can was machined off the consolidated ribbon plug. The HIPped sample was a plug about one inch in diameter and three inches long.

The plug was placed axially into a center opening of a billet and sealed therein. The billet was heated to 975° C. (1787° F.) and was extruded through a die to give a reduction ratio of about 7 to 1. The extruded plug was removed from the billet and was heat treated.

The extruded samples were then annealed at temperatures as indicated in Table I for two hours. The annealing was followed by aging at 1000° C. for two hours. Specimens were machined to the dimension of 1.5×3×25.4 mm (0.060×0.120×1.0 in) for four point bending tests at room temperature. The bending tests were carried out in a 4-point bending fixture having an inner span of 10 mm (0.4 in) and an outer span of 20 mm (0.8 in). The load-crosshead displacement curves were recorded. Based on the curves developed the following properties are defined:

1. Yield strength is the flow stress at a cross head offset displacement of one thousandth of an inch. This amount of cross head displacement is taken as the first evidence of plastic deformation and the transition from elastic deformation to plastic deformation. The measurement of yield and/or fracture strength by conventional compression or tension methods tends to give results which are lower than the results obtained by four point bending as carried out in making the measurements reported herein. The higher levels of the results from four point bending measurements should be kept in mind when comparing these values to values obtained by the conventional compression or tension methods. However, the comparison of measurement results in the examples herein is between four point bending tests for all samples measured and such comparisons are quite valid in establishing the differences in strength properties resulting from differences in composition or in processing of the compositions.

2. Fracture strength is the stress to fracture.

3. Outer fiber strain is the quantity of 9.71hd where h is the specimen thickness in inches and d is the cross head displacement of fracture in inches. Metallurgically, the value calculated represents the amount of plastic deformation experienced at the outer surface of the bending specimen at the time of fracture.

Figure 2:
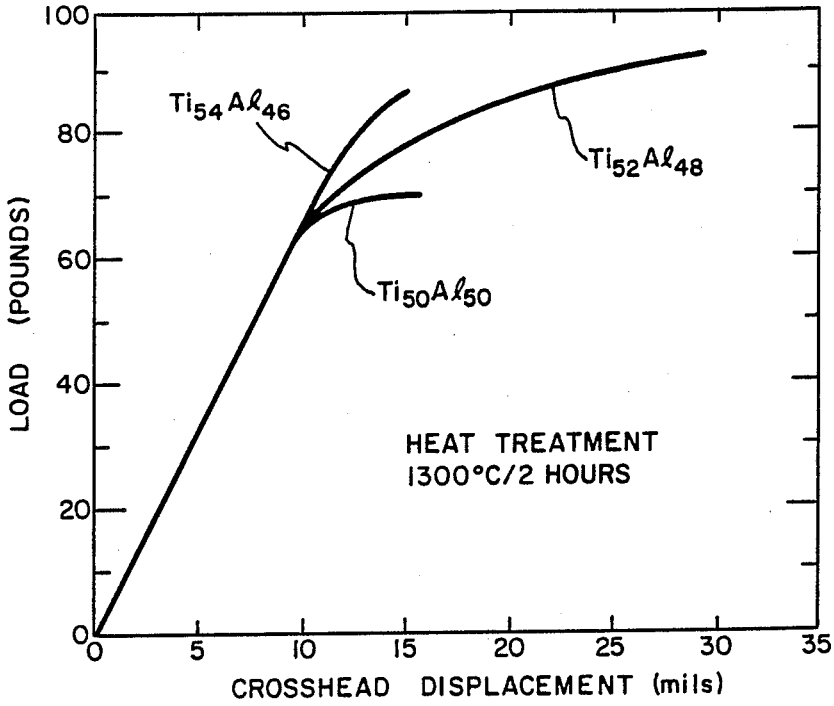
FIG. 2 is a graph illustrating the relationship between load in pounds and crosshead displacement in mils for TiAl compositions of different stoichiometry tested in 4-point bending.

The results are listed in the following Table I. Table I contains data on the properties of samples annealed at 1300° C. and further data on these samples in particular is given in FIG. 2.

TABLE I

| Ex. No. | Gamma Alloy No. | Composit. (at. %) | Anneal Temp. (°C.) | Yield Strength (ksi) | Fracture Strength (ksi) | Outer Fiber Strain (%) |
|---|---|---|---|---|---|---|
| 1 | 83 | $Ti_{54}Al_{46}$ | 1250 | 131 | 132 | 0.1 |
| | | | 1300 | 111 | 120 | 0.1 |

TABLE I-continued

| Ex. No. | Gamma Alloy No. | Composit. (at. %) | Anneal Temp. (°C.) | Yield Strength (ksi) | Fracture Strength (ksi) | Outer Fiber Strain (%) |
|---|---|---|---|---|---|---|
| | | | 1350 | —* | 58 | 0 |
| 2 | 12 | $Ti_{52}Al_{48}$ | 1250 | 130 | 180 | 1.1 |
| | | | 1300 | 98 | 128 | 0.9 |
| | | | 1350 | 88 | 122 | 0.9 |
| | | | 1400 | 70 | 85 | 0.2 |
| 3 | 85 | $Ti_{50}Al_{50}$ | 1250 | 83 | 92 | 0.3 |
| | | | 1300 | 93 | 97 | 0.3 |
| | | | 1350 | 78 | 88 | 0.4 |

*No measurable value was found because the sample lacked sufficient ductility to obtain a measurement.

It is evident from the data of this table that alloy 12 for Example 2 exhibited the best combination of properties. This confirms that the properties of Ti-Al compositions are very sensitive to the Ti/Al atomic ratios and to the heat treatment applied. Alloy 12 was selected as the base alloy for further property improvements based on further experiments which were performed as described below.

It is also evident that the anneal at temperatures between 1250° C. and 1350° C. results in the test specimens having desirable levels of yield strength, fracture strength and outer fiber strain. However, the anneal at 1400° C. results in a test specimen having a significantly lower yield strength (about 20% lower); lower fracture strength (about 30% lower) and lower ductility (about 78% lower) than a test specimen annealed at 1350° C. The sharp decline in properties is due to a dramatic change in microstructure due in turn to an extensive beta transformation at temperatures appreciably above 1350° C.

EXAMPLES 4–13

Ten additional individual melts were prepared to contain titanium and aluminum in designated atomic ratios as well as additives in relatively small atomic percents.

Each of the samples was prepared as described above with reference to Examples 1–3.

The compositions, annealing temperatures, and test results of tests made on the compositions are set forth in Table II in comparison to alloy 12 as the base alloy for this comparison.

TABLE II

| Ex. No. | Gamma Alloy No. | Composit. (at. %) | Anneal Temp. (°C.) | Yield Strength (ksi) | Fracture Strength (ksi) | Outer Fiber Strain (%) |
|---|---|---|---|---|---|---|
| 2 | 12 | $Ti_{52}Al_{48}$ | 1250 | 130 | 180 | 1.1 |
| | | | 1300 | 98 | 128 | 0.9 |
| | | | 1350 | 88 | 122 | 0.9 |
| 4 | 22 | $Ti_{50}Al_{47}Ni_3$ | 1200 | —* | 131 | 0 |
| 5 | 24 | $Ti_{52}Al_{46}Ag_2$ | 1200 | —* | 114 | 0 |
| | | | 1300 | 92 | 117 | 0.5 |
| 6 | 25 | $Ti_{50}Al_{48}Cu_2$ | 1250 | —* | 83 | 0 |
| | | | 1300 | 80 | 107 | 0.8 |
| | | | 1350 | 70 | 102 | 0.9 |
| 7 | 32 | $Ti_{54}Al_{45}Hf_1$ | 1250 | 130 | 136 | 0.1 |
| | | | 1300 | 72 | 77 | 0.1 |
| 8 | 41 | $Ti_{52}Al_{44}Pt_4$ | 1250 | 132 | 150 | 0.3 |
| 9 | 45 | $Ti_{51}Al_{47}C_2$ | 1300 | 136 | 149 | 0.1 |
| 10 | 57 | $Ti_{50}Al_{48}Fe_2$ | 1250 | —* | 89 | 0 |
| | | | 1300 | —* | 81 | 0 |
| | | | 1350 | 86 | 111 | 0.5 |
| 11 | 82 | $Ti_{50}Al_{48}Mo_2$ | 1250 | 128 | 140 | 0.2 |
| | | | 1300 | 110 | 136 | 0.5 |
| | | | 1350 | 80 | 95 | 0.1 |
| 12 | 39 | $Ti_{50}Al_{46}Mo_4$ | 1200 | —* | 143 | 0 |

TABLE II-continued

| Ex. No. | Gamma Alloy No. | Composit. (at. %) | Anneal Temp. (°C.) | Yield Strength (ksi) | Fracture Strength (ksi) | Outer Fiber Strain (%) |
|---|---|---|---|---|---|---|
| | | | 1250 | 135 | 154 | 0.3 |
| | | | 1300 | 131 | 149 | 0.2 |
| 13 | 20 | $Ti_{49.5}Al_{49.5}Er_1$ | + | + | + | + |

*See asterisk note to Table I.

+ Material fractured during machining to prepare test specimens.

For Examples 4 and 5 heat treated at 1200° C., the yield strength was unmeasurable as the ductility was found to be essentially nil. For the specimen of Example 5 which was annealed at 1300° C., the ductility increased, but it was still undesirably low.

For Example 6 the same was true for the test specimen annealed at 1250° C. For the specimens of Example 6 which were annealed at 1300° and 1350° C. the ductility was significant but the yield strength was low.

None of the test specimens of the other Examples were found to have any significant level of ductility.

It is evident from the results listed in Table II that the sets of parameters involved in preparing compositions for testing are quite complex and interrelated. One parameter is the atomic ratio of the titanium relative to that of aluminum. From the data plotted in FIG. 2 it is evident that the stoichiometric ratio or non-stoichiometric ratio has a strong influence on the test properties which formed for different compositions.

Another set of parameters is the additive chosen to be included into the basic TiAl composition. A first parameter of this set concerns whether a particular additive acts as a substituent for titanium or for aluminum. A specific metal may act in either fashion and there is no simple rule by which it can be determined which role an additive will play. The significance of this parameter is evident if we consider addition of some atomic percentage of additive X.

If X acts as a titanium substituent then a composition $Ti_{48}Al_{48}X_4$ will give an effective aluminum concentration of 48 atomic percent and an effective titanium concentration of 52 atomic percent.

If by contrast the X additive acts as an aluminum substituent then the resultant composition will have an effective aluminum concentration of 52 percent and an effective titanium concentration of 48 atomic percent.

Accordingly the nature of the substitution which takes place is very important but is also highly unpredictable.

Another parameter of this set is the concentration of the additive.

Still another parameter evident from Table II is the annealing temperature. The annealing temperature which produces the best strength properties for one additive can be seen to be different for a different additive. This can be seen by comparing the results set forth in Example 6 with those set forth in Example 7.

In addition there may be a combined concentration and annealing effect for the additive so that optimum property enhancement, if any enhancement is found, can occur at a certain combination of additive concentration and annealing temperature so that higher and lower concentrations and/or annealing temperatures are less effective in providing a desired property improvement.

The content of Table II makes clear that the results obtainable from addition of a ternary element to a non-stoichiometric TiAl composition are highly unpredictable and that most test results are unsuccessful with respect to ductility or strength or to both.

EXAMPLES 14–17

Four additional samples were prepared as described above with reference to Examples 1–3 to contain titanium aluminide having compositions respectively as listed in Table III.

The Table III summarizes the bend test results on all of the alloys both standard and modified under the various heat treatment conditions deemed relevant.

TABLE III

Four-Point Bend Properties of W-Modified TiAl Alloys

| Ex. | Gamma Alloy Number | Composition (at. %) | Annealing Temperature (°C.) | Yield Strength (ksi) | Fracture Strength (ksi) | Outer Fiber Strain (%) | Weight Loss After 48 hours at 980° C. (mg/cm2) |
|---|---|---|---|---|---|---|---|
| 2 | 12 | $Ti_{52}Al_{48}$ | 1250 | 130 | 180 | 1.1 | + |
| | | | 1300 | 98 | 128 | 0.9 | + |
| | | | 1350 | 88 | 122 | 0.9 | 31 |
| | | | 1400 | 70 | 85 | 0.2 | + |
| 14 | 120 | $Ti_{52}Al_{46}W_2$ | 1250 | * | 74 | 0 | + |
| | | | 1300 | 114 | 147 | 0.51 | + |
| | | | 1350 | 69 | 79 | 0.27 | + |
| | | | 1400 | * | 43 | 0 | 2 |
| 15 | 15 | $Ti_{50}Al_{48}W_2$ | 1250 | 105 | 136 | 0.5 | + |
| | | | 1300 | 114 | 147 | 1.0 | 1 |
| | | | 1350 | 101 | 139 | 1.0 | + |
| 16 | 93 | $Ti_{48}Al_{50}W_2$ | 1250 | * | 97 | 0 | + |
| | | | 1300 | 111 | 124 | 0.3 | + |
| | | | 1350 | 118 | 125 | 0.2 | + |
| | | | 1400 | * | 76 | 0 | + |

TABLE III-continued

| Four-Point Bend Properties of W-Modified TiAl Alloys | | | | | | | |
|---|---|---|---|---|---|---|---|
| Ex. | Gamma Alloy Number | Composition (at. %) | Annealing Temperature (°C.) | Yield Strength (ksi) | Fracture Strength (ksi) | Outer Fiber Strain (%) | Weight Loss After 48 hours at 980° C. (mg/cm2) |
| 17 | 16 | $Ti_{48}Al_{48}W_4$ | 1300 | 122 | 161 | 0.9 | 0 |

*see Table I
– not measured

From the results tabulated in Table III, it is evident that alloys 15 and 16 are the alloys displaying a remarkably good combination of properties including yield strength, fracture strength, ductility, and resistance to high temperature (980° C.) oxidation.

The test of oxidation, and the complementary test of oxidation resistance, involves heating a sample to be tested at a temperature of 982° C. for a period of 48 hours. After the sample has cooled, it is scraped to remove any oxide scale. By weighing the sample both before and after the heating and scraping, a weight difference can be determined. Weight loss is determined in $mg/cm^2$ by dividing the total weight loss in grams by the surface area of the specimen in square centimeters. This oxidation test is the one used for all measurements of oxidation or oxidation resistance as set forth in this application.

In this regard, please note that the alloy 12 of Example 2 contained no tungsten and the weight loss after 48 hours at 980° C. was quite high and specifically 31 $mg/cm^2$.

By contrast, alloys 120 and 15 which each contained 2 atomic percent tungsten had weight loss after heating for 48 hours at 980° C. of only 2 $mg/cm^2$ and 1 $mg/cm^2$ respectively. This represents a fifteen fold reduction for alloy 120 and an even more remarkable thirty fold reduction for alloy 15.

Probably most remarkable of all is the reduction to zero to alloy 16 containing 4 atomic percent tungsten.

At the same time that these very good reductions in weight loss are achieved, the alloys display a unique and unusual high strength coupled with a valuable ductility. It is the strength of these alloys though when coupled with oxidation resistance which is their most unique and valuable property set.

Please note, for example, the $Ti_{50}Al_{48}W_2$ alloy annealed at 1300° C. The yield strength is increased over the base alloy by 16%. The fracture strength is increased by 20%. The ductilities are about equal. But the oxidation resistance at 980° C. is improved over thirty fold. The combined improvement is thus truly remarkable.

The properties of the tungsten-containing alloy relative to the base $Ti_{52}Al_{48}$ alloy are plotted in the figures.

Figure 3:
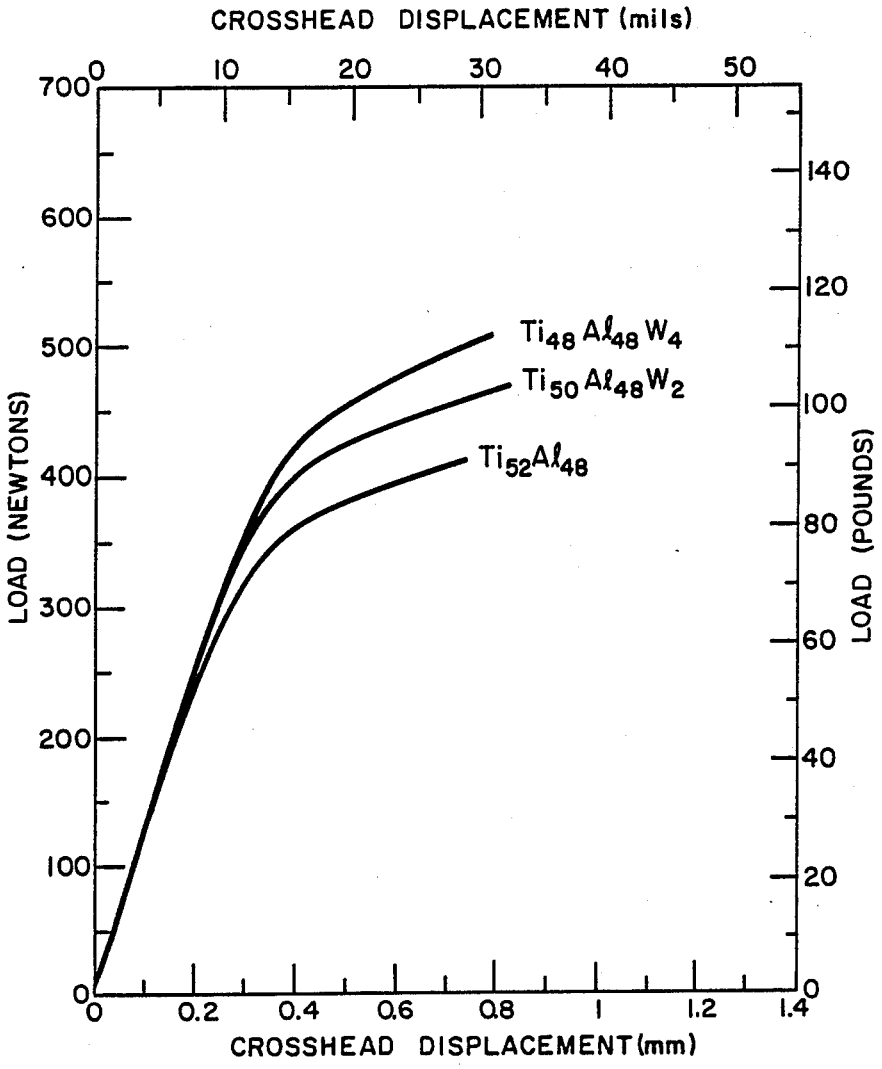
FIG. 3 is a graph similar to that of FIG. 2 in which a comparison of the relationship of the properties of TiAl to those of tungsten modified TiAl is provided.

FIG. 3 illustrates the relationship between load in pounds and cross heat displacement in mils.

Figure 4:
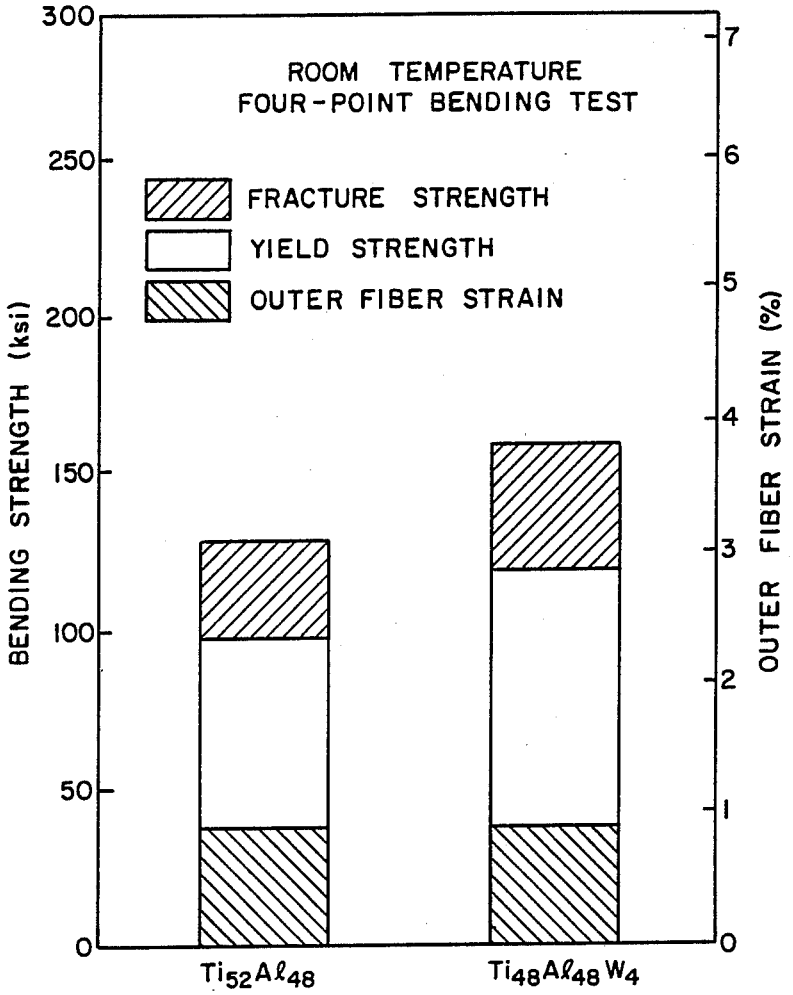
FIG. 4 is a bar graph showing the values of fracture strength, yield strength and outer fiber strain for $Ti_{4.8}Al_{48}W_4$ in relation to the base metal.

FIG. 4 illustrates the comparative strength and ductility as measured by the four point bending test for alloys 12 and 16 after annealing at 1300° C.

Figure 5:
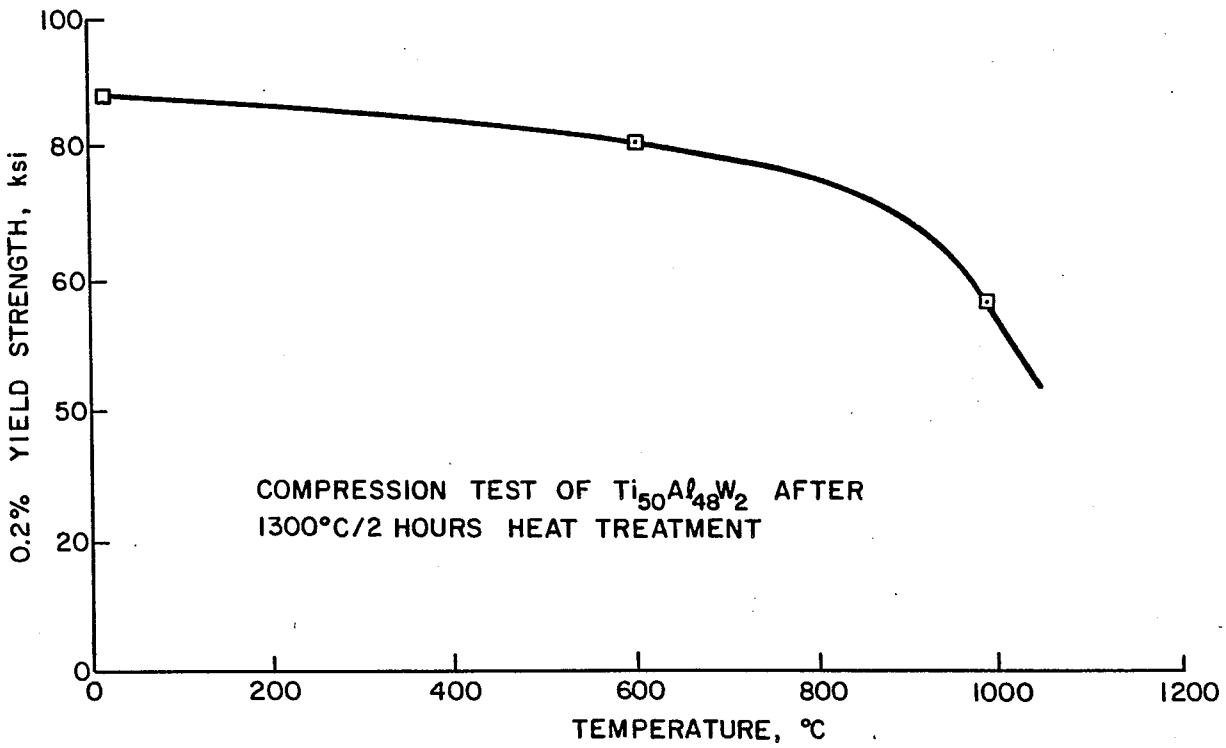
FIG. 5 is a graph in which yield strength in psi is plotted against test temperature for a sample of $Ti_{5.0}Al_{48}W_2$ annealed at 1300° C. as measured by a conventional compression test. The measurement of yield and rupture strength by conventional compression or tension methods tends to be lower than the results obtained by four point bending as is evident by comparing the results plotted in this figure with those plotted in FIG. 4.

FIG. 5 illustrates yield strength versus temperature.

Figure 6:
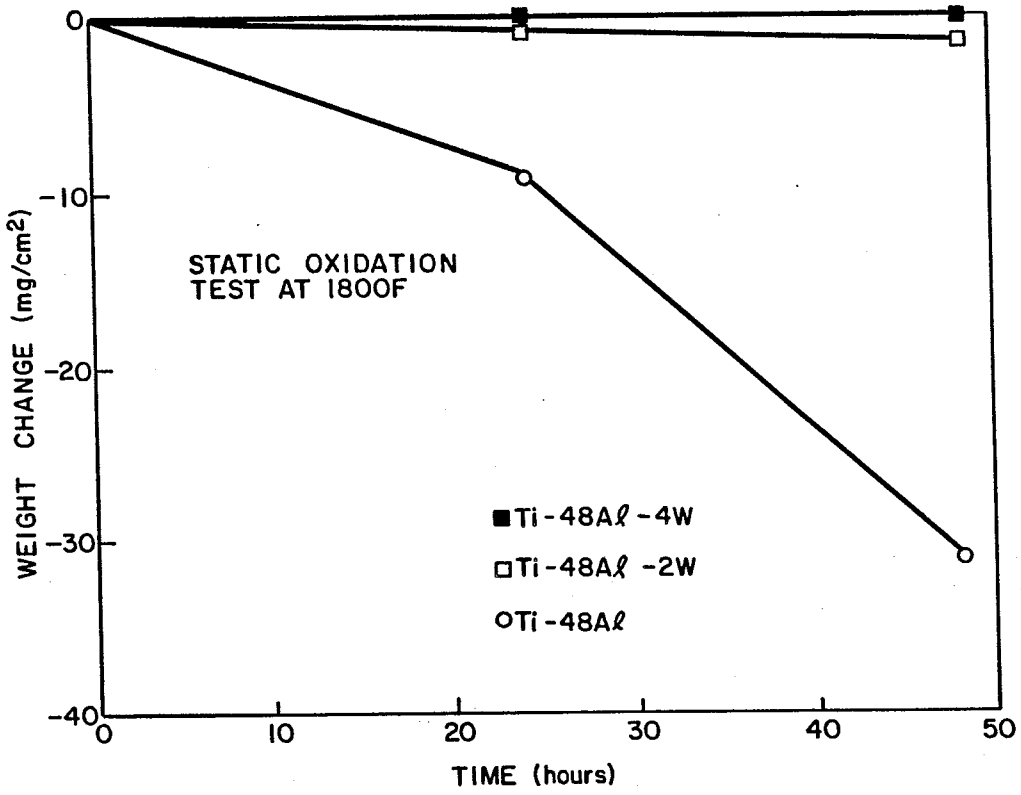
FIG. 6 is a graph displaying comparative oxidation resistance properties.

FIG. 6 illustrates comparative oxidation resistance.

What is claimed is:

1. The process of forming a titanium aluminide having good strength and ductility and high oxidation resistance which comprises, doping a TiAl with tungsten to provide a composition as follows:

$$Ti_{52-46}Al_{47-49}W_{1-5},$$

rapidly solidifying the composition from a melt thereof, hot isostatically pressing the rapidly solidified composition, and annealing the pressed composition at a temperature of 1250° to 1350° C.

2. The process of claim 1, wherein the composition is aged after it is annealed.

3. The process of claim 1, wherein the composition is aged at a temperature of about 1000° C. for a time of about 2 hours.

4. The method of claim 1, wherein the composition is as follows:

$$Ti_{51-47}Al_{48-49}W_{1-5}.$$

5. The method of claim 1, wherein the composition is as follows:

$$Ti_{51-47}Al_{47-49}W_{2-4}.$$

6. The method of claim 1, wherein the composition is as follows:

$$Ti_{50-48}Al_{48}W_{2-4}.$$

7. The method of claim 1, wherein the consolidation is at 30 ksi for 3 hours at 950° C.

* * * * *